US010025265B2

(12) United States Patent
Shida et al.

(10) Patent No.: US 10,025,265 B2
(45) Date of Patent: Jul. 17, 2018

(54) DEVELOPER CONTAINER, DEVELOPING DEVICE, PROCESS CARTRIDGE, AND IMAGE FORMING APPARATUS

(71) Applicant: CANON KABUSHIKI KAISHA, Tokyo (JP)

(72) Inventors: Kazuhisa Shida, Kawasaki (JP); Shunsuke Mizukoshi, Yokohama (JP); Yuta Isobe, Kawasaki (JP); Takayuki Kanazawa, Yokohama (JP); Makoto Tokudome, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/480,134

(22) Filed: Apr. 5, 2017

(65) Prior Publication Data

US 2017/0293256 A1 Oct. 12, 2017

(30) Foreign Application Priority Data

Apr. 8, 2016 (JP) ..... 2016-078265

(51) Int. Cl.
*G03G 15/08* (2006.01)
*G03G 21/16* (2006.01)

(52) U.S. Cl.
CPC ..... *G03G 21/1676* (2013.01); *G03G 15/0898* (2013.01); *G03G 21/1647* (2013.01)

(58) Field of Classification Search
CPC ..... G03G 15/0898; G03G 15/0882; G03G 21/1676; G03G 21/1647; G03G 2215/0687
See application file for complete search history.

(56) References Cited

U.S. PATENT DOCUMENTS 5,030,998 A 7/1991 Shibata
2011/0293319 A1* 12/2011 Merrifield ..... G03G 15/0898 399/106
2014/0212166 A1* 7/2014 Takeuchi ..... G03G 15/0898 399/106

FOREIGN PATENT DOCUMENTS

JP 05-197288 A 8/1993

* cited by examiner

*Primary Examiner* — Sophia S Chen
(74) *Attorney, Agent, or Firm* — Canon U.S.A., Inc. IP Division

(57) ABSTRACT

A configuration in which an opening is covered with a plurality of partition members is provided, and timings of causing the partition members to move are differentiated, so that torque is reduced.

9 Claims, 12 Drawing Sheets

DEVELOPER CONTAINER, DEVELOPING DEVICE, PROCESS CARTRIDGE, AND IMAGE FORMING APPARATUS

BACKGROUND OF THE INVENTION

Field of the Invention

The present disclosure relates to a developer container, a developing device, a process cartridge, and an image forming apparatus. The image forming apparatus here means an apparatus that forms an image on a recording material. The process cartridge means one that has at least an image bearing member. In many cases, the process cartridge is one that is formed by making a charging unit, a developing unit, a cleaning unit, and the image bearing member into a cartridge integrally so as to be detachably attachable to an apparatus main body of an image forming apparatus. Moreover, the developing device means one that has at least a developer bearing member. In many cases, the developing device is one that is formed by integrating the developer bearing member, a developing frame which supports the developer bearing member, and parts related thereto so as to be detachably attachable to an apparatus main body of an image forming apparatus. In addition, the developer container means a container for accommodating developer.

Description of the Related Art

For an image forming apparatus of an electrophotographic system, a cartridge type in which at least a developing unit and a developing device in which developer is accommodated are integrally formed so as to be detachably attachable to the image forming apparatus is widely known. Moreover, a cartridge type is also widely known in which a developing device and an image bearing member unit that has an image bearing member are integrally formed (so-called process cartridge) so as to be detachably attachable to the image forming apparatus (Japanese Patent Laid-Open No. 05-197288 and U.S. Pat. No. 5,030,998).

An image forming apparatus of such a cartridge type is described in Japanese Patent Laid-Open No. 05-197288. Moreover, a configuration of a cartridge, in which a toner supply opening that connects a toner chamber and a toner supply chamber is included, is described in Japanese Patent Laid-Open No. 05-197288.

A toner sealing member is opened in such a manner that one end thereof is attached to a rotating member in the toner chamber and the toner sealing member is rolled up by the rotating member when the rotating member rotates.

By being sealed with the toner sealing member, toner is able to be prevented from leaking out from the cartridge due to an oscillation or an impact caused to the cartridge. Moreover, the toner sealing member of Japanese Patent Laid-Open No. 05-197288 remains in the cartridge after being opened, so that a user does not need to dispose of the toner sealing member. Furthermore, since the user does not need to open the toner sealing member, usability is enhanced.

However, in a case where the automatic rolling-up configuration of the toner sealing member, which is described in Japanese Patent Laid-Open No. 05-197288, is provided in an image forming apparatus, a motor which is a driving source is required to be larger or more expensive in accordance with a maximum rolling-up force. Moreover, it is necessary to secure strength corresponding thereto for parts of a driving system. There is a possibility that such a case may lead to increases in size or cost of an image forming apparatus.

Thus, a technique has been desired to reduce torque at a time of pulling the sealing member.

SUMMARY OF THE INVENTION

The present disclosure provides a developer container, including, a frame that includes an opening and accommodates developer, first and second partition members each of which covers at least a part of the opening, and an opening member that is arranged at a position that allows contact with the developer, fixes one edge of each of the first and second partition members, and opens the opening by causing the first and second partition members to move, in which, in a state where at least a part of the opening is covered with the first and second partition members, the first partition member includes an overlapping part with which at least a part of the second partition member overlaps, at least a part of the overlapping part overlaps with a part of the opening, and in a case of opening the opening, the first partition member moves away and separates from the frame earlier than the second partition member does.

Moreover, the disclosure provides a developing device, a process cartridge, and an image forming apparatus.

Further features of the present disclosure will become apparent from the following description of exemplary embodiments with reference to the attached drawings.

DESCRIPTION OF THE EMBODIMENTS

With reference to drawings, embodiments for implementing the disclosure will be hereinafter exemplified in detail on the basis of examples. Note that, dimensions, materials, and shapes of components, relative positions therebetween, and the like which are described in the embodiments are to be appropriately modified in accordance with a configuration of an apparatus to which the disclosure is applied and various conditions. That is, there is no intention to limit the scope of the disclosure to the following embodiments.

Example 1

A first embodiment of the disclosure will be specifically described.

<Entire Configuration of Image Forming Apparatus>

Figure 1A:
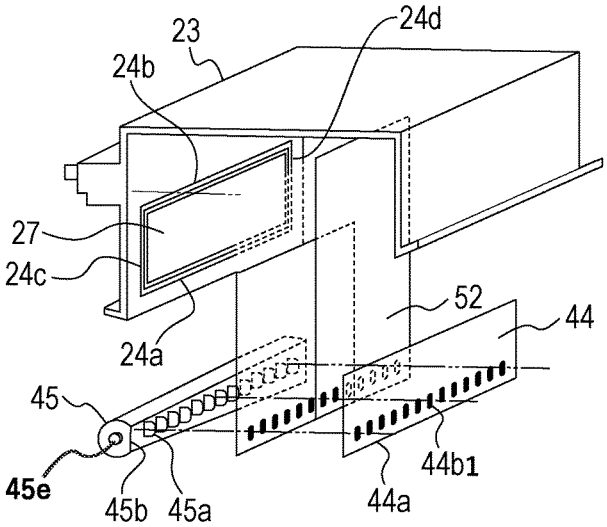
FIGS. 1A to 1C are plan views for explaining a toner sealing configuration and a positional relation between a toner sealing member and a sealing portion according to a first example.
Figure 1B:
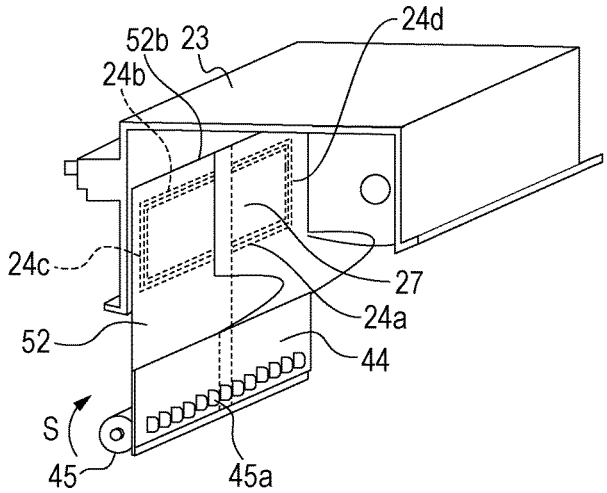
Figure 1C:
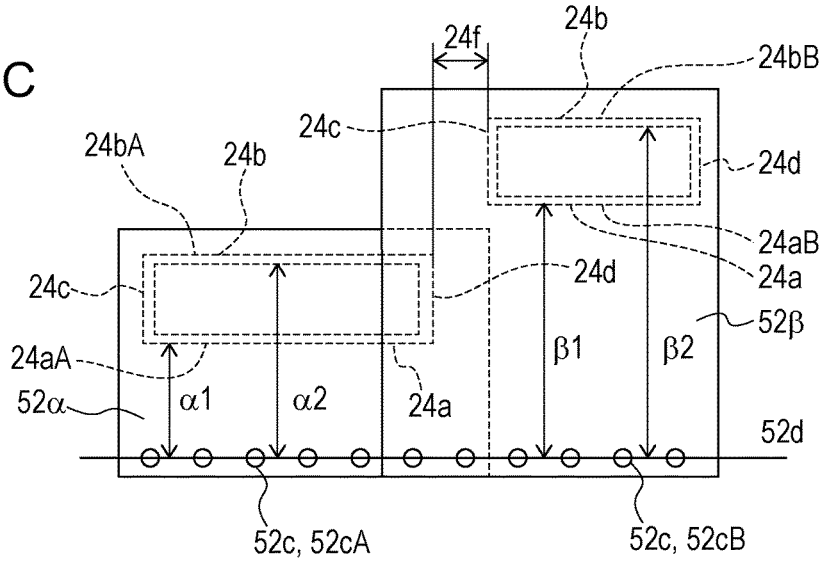
Figure 2:
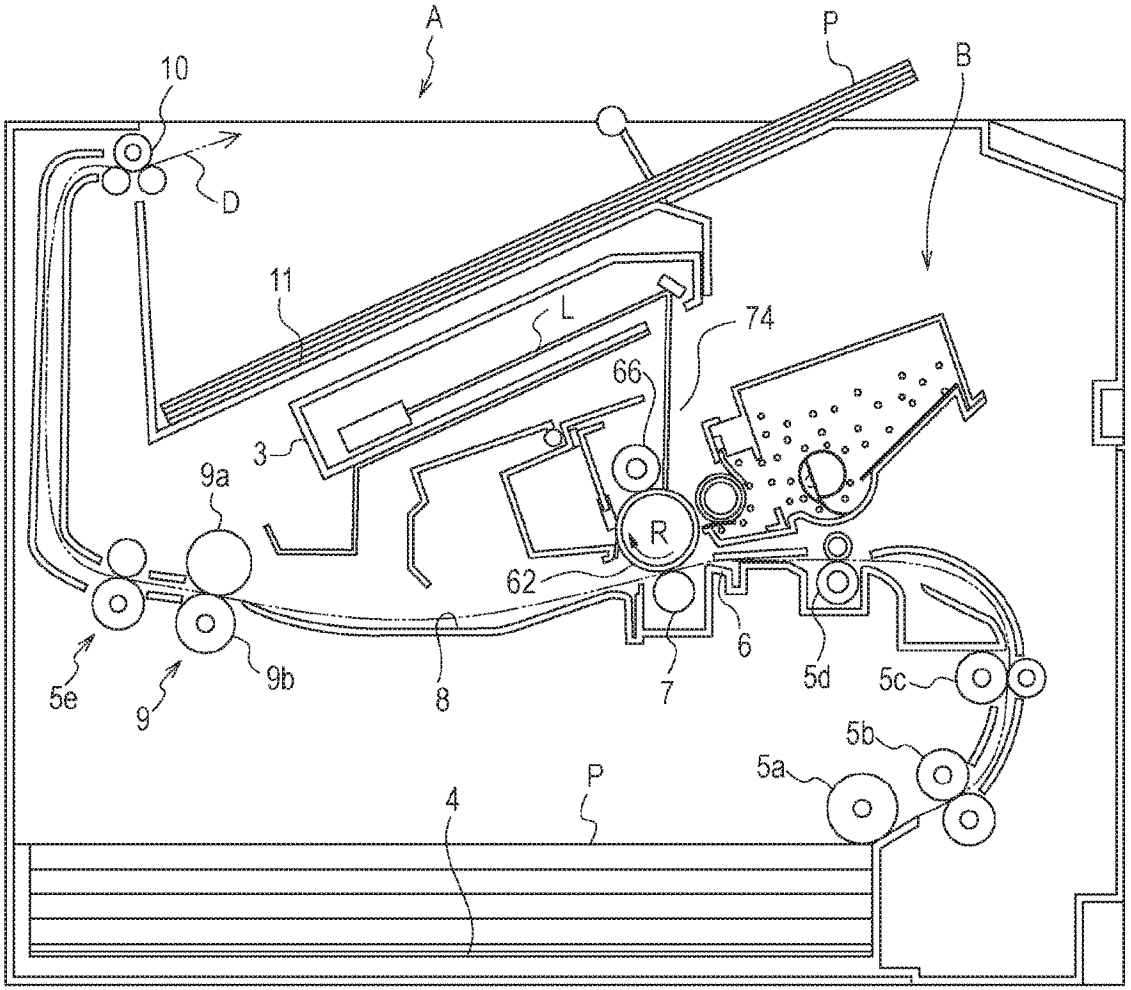
FIG. 2 is a sectional view of an image forming apparatus main body and a process cartridge of an electrophotographic image forming apparatus according to the first example.

In FIG. 2, an image forming apparatus is a laser beam printer adopting an electrophotographic system, in which a cartridge B is detachably attachable. When the cartridge B is attached to an apparatus main body A, an exposure device 3 which is composed of a laser scanner unit is arranged on an upper side of the cartridge B.

The apparatus main body A of the image forming apparatus means a part of a configuration of the apparatus, which is obtained by excluding the cartridge B from the image forming apparatus. In the present example, description is given with a configuration in which the cartridge B is detachably attachable, but a developer container or a developing device may be configured to be detachably attachable to the image forming apparatus. In this case, the apparatus main body of the image forming apparatus means a part of the apparatus excluding the developer container or the developing device.

On a lower side of the cartridge B, a sheet tray 4 in which a sheet material P as a recording material to be subjected to image formation is accommodated is arranged.

Further, in the apparatus main body A, along a conveyance direction D of the sheet material P serving as the recording material, a pickup roller 5*a* is provided, and further a feeding roller 5*b*, a conveyance roller 5*c*, a registration roller 5*d*, a transfer guide 6, a transfer roller 7 serving as a transfer unit, and a conveyance guide 8 are provided. Furthermore, a fixing device 9 serving as a fixing unit, a conveyance roller 5*e*, a discharge roller 10, a discharge tray 11, and the like are sequentially arranged. Note that, the fixing device 9 is configured by including a heating roller 9*a* and a pressing roller 9*b*.

Though a monochrome image forming apparatus is used in the present example, there is no limitation thereto. The disclosure is also applicable to a color image forming apparatus, to which a plurality of cartridges are detachably attachable, and the like.

<Image Forming Process Operation>

Next, description will be given for an image forming process operation. A photoconductive drum 62 serving as an image bearing member is rotationally driven at a predetermined circumferential velocity (process speed) in a direction of an arrow R in FIG. 2 on the basis of a print start signal.

A charging roller 66 serving as a charging unit, to which a charging bias voltage is applied by a charging bias power source which is not illustrated, is in contact with an outer peripheral surface of the photoconductive drum 62, and uniformly and equally charges the outer peripheral surface of the photoconductive drum 62.

The exposure device 3 serving as an exposure unit outputs laser light L in accordance with image information. The laser light L passes through an exposure window 74 which is provided on a top surface of the cartridge B, and scans and exposes the outer peripheral surface of the photoconductive drum 62. Thereby, an electrostatic latent image corresponding to the image information is formed on the outer peripheral surface of the photoconductive drum 62 serving as the image bearing member.

Figure 3:
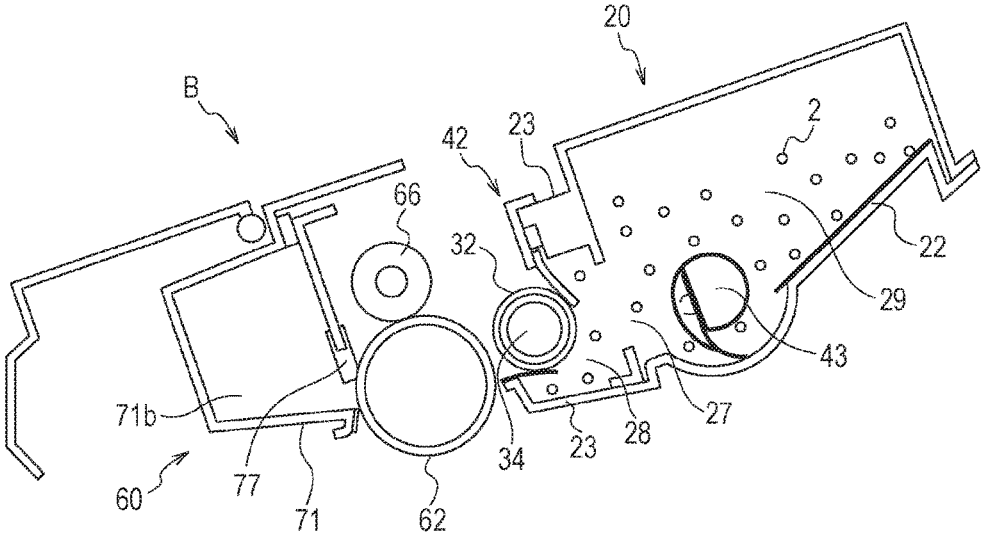
FIG. 3 is a sectional view of the process cartridge according to the first example.

On the other hand, as illustrated in FIG. 3, a frame in which toner 2 serving as developer is accommodated is provided in a developing unit 20 serving as the developing device. The frame has an opening, and is able to accommodate the developer therein. In addition, the frame is constituted by a developing container 23 (first frame) and a bottom member 22 (second frame). The developing container 23 has a toner supply opening 27 having a quadrilateral (or rectangle) shape, which is to be an opening through which the toner 2 is accommodated. The developing container 23 and the bottom member 22 constitute a toner chamber 29 in which the toner 2 is accommodated. The toner 2 in the toner chamber 29 is stirred and conveyed by rotation of a conveyance member 43. Then, the toner 2 is sent to a toner supply chamber 28, in which a developing roller 32 serving as a developer bearing member is provided, from the toner chamber 29 via the toner supply opening 27.

The toner 2 is carried on a surface of the developing roller 32 serving as the developer bearing member by a magnetic force of a magnet roller 34 (a stationary magnet).

While the toner 2 carried on the surface of the developing roller 32 (developing sleeve) is triboelectrically charged, a layer thickness of the toner 2 on the surface of the developing roller 32 is regulated by a developing blade 42.

The toner 2 carried on the surface of the developing roller 32 (developing sleeve) is transferred onto the electrostatic latent image formed on the outer peripheral surface of the photoconductive drum 62, and visualized as a developer image (or toner image) on the outer peripheral surface.

As illustrated in FIG. 2, at the same timing as an outputting timing of the laser light L, the sheet material P accommodated in a lower part of the apparatus main body A of the image forming apparatus is fed from the sheet tray 4 by the pickup roller 5*a*, the feeding roller 5*b*, and the conveyance roller 5*c*.

Thereafter, via the transfer guide 6, the sheet material P is supplied at a transfer position between the photoconductive drum 62 and the transfer roller 7. At the transfer position, the developer image (or toner image) formed on the surface of the photoconductive drum 62 is sequentially transferred onto the sheet material P.

The sheet material P onto which the developer image (or toner image) is transferred is separated from the photoconductive drum 62, and conveyed to the fixing device 9 along the conveyance guide 8. Then, the sheet material P passes through a fixing nip portion formed by the heating roller 9*a* and pressing roller 9*b* which constitute the fixing device 9.

Fixing processing with heating and pressing is performed in the fixing nip portion, and then the developer image (toner image) is fixed to the sheet material P. The sheet material P subjected to the fixing processing of the developer image (toner image) is conveyed to the discharge roller 10 by the conveyance roller 5*e*, and discharged to the discharge tray 11.

On the other hand, as illustrated in FIG. 3, by a cleaning blade 77, residual toner is removed from the surface of the photoconductive drum 62 after the transfer, and the surface is used for the image forming process operation again. Waste toner removed from the photoconductive drum 62 is stored in a waste toner chamber 71*b* of a cleaning unit 60.

In the above-described configuration, the charging roller 66, the developing roller 32, and the cleaning blade 77 are an image forming process unit that acts on the photoconductive drum 62.

<Entire Configuration of Cartridge>

Figure 4:
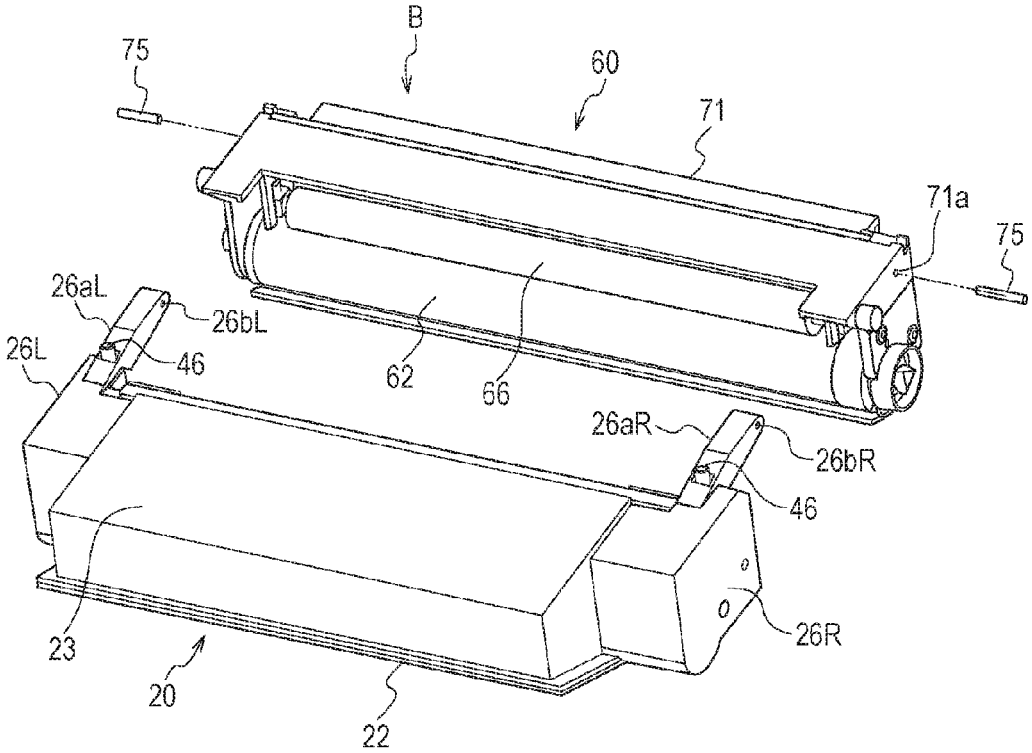
FIG. 4 is a perspective view for explaining a configuration of the process cartridge according to the first example.

Next, an entire configuration of the cartridge B will be described by using FIG. 4. FIG. 4 is an exploded perspective view for explaining the configuration of the cartridge B.

As illustrated in FIG. 4, the cartridge B is configured by combining the cleaning unit 60 and the developing unit 20. The cartridge B has a configuration which is referred to as a so-called process cartridge.

The cleaning unit 60 is configured by including a cleaning frame 71, the photoconductive drum 62, the charging roller 66, the cleaning blade 77, and the like.

On the other hand, the developing unit 20 is configured by including the developing container 23, the bottom member 22, side members 26L and 26R, the developing blade 42, the developing roller 32, the magnet roller 34, the conveyance member 43, the toner 2, urging members 46, and the like.

The cartridge B is formed by combining the cleaning unit 60 and the developing unit 20 with combining members 75 illustrated in FIG. 4, each of which has a pin shape, so as to be able to pivot with respect to each other.

Specifically, the side members 26L and 26R are provided in both end parts of the developing unit 20 in a longitudinal direction (rotation axial direction of the developing roller 32). Moreover, pivot holes 26*b*L and 26*b*R each of which is arranged in parallel to a rotation axis of the developing roller 32 are respectively provided in tip parts of arm parts 26*a*L and 26*a*R which are formed in the side members 26L and 26R, respectively.

In addition, fitting holes 71*a* to which the combining members 75 each having the pin shape is fitted are formed in both end parts of the cleaning frame 71 in a longitudinal direction thereof so as to be arranged in parallel to a rotation axis of the photoconductive drum 62.

The arm parts 26*a*L and 26*a*R are fitted to the both end parts of the cleaning frame 71 in the longitudinal direction thereof, and the combining members 75 are respectively inserted into the pivot holes 26*b*L and 26*b*R of the arm parts 26*a*L and 26*a*R and the fitting holes 71*a* for locking. Thereby, in the present example, the cleaning unit 60 and the developing unit 20 are combined so as to be able to pivot on the combining members 75, and constitute the process cartridge.

At this time, the urging members 46 which are attached to root parts of the arm parts 26*a*L and 26*a*R respectively abut against abutting portions 71*c*L and 71*c*R which are provided in the both end parts of the cleaning frame 71 in the longitudinal direction. Then, by an urging force of the urging members 46, the developing unit 20 is urged toward the cleaning unit 60 with the combining members 75 as the center of pivot. Thereby, the developing roller 32 serving as the developer bearing member is reliably pressed toward the photoconductive drum 62 serving as the image bearing member.

Figure 6:
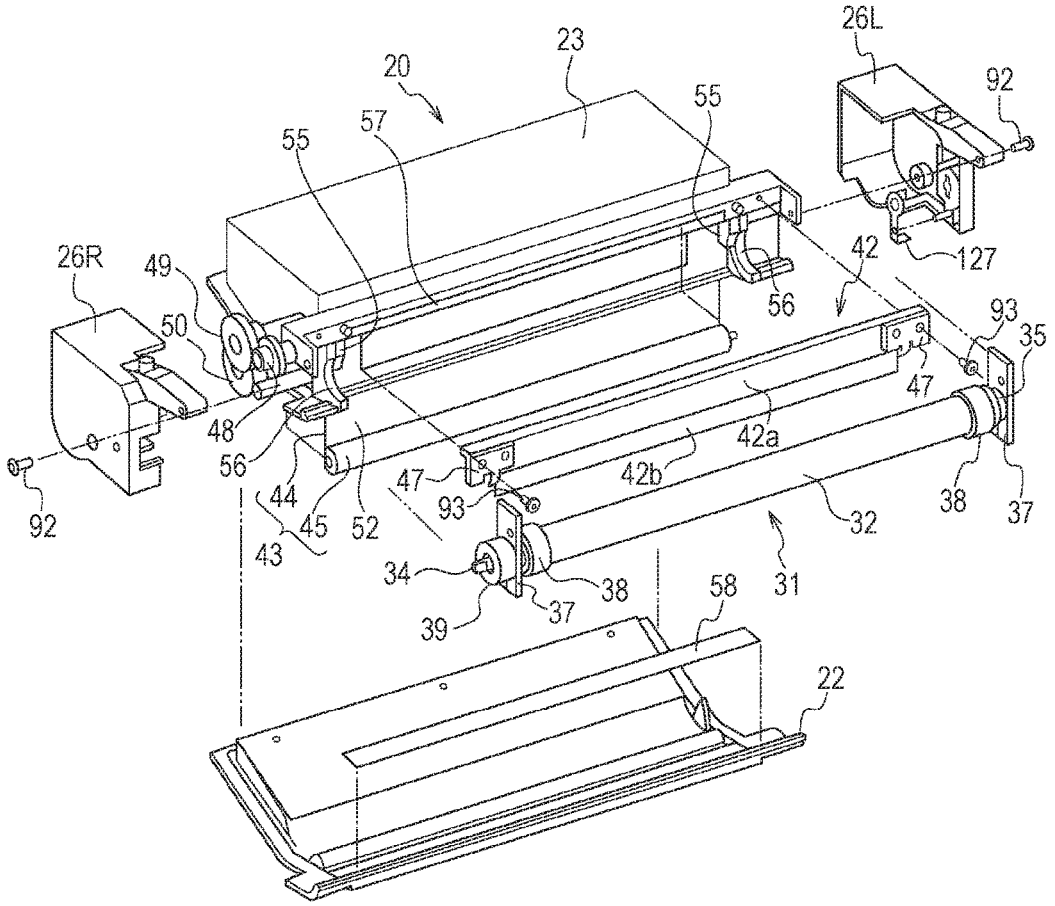
FIG. 6 is a perspective view for explaining a configuration of a developing unit according to the first example.

The developing roller 32 is held apart from the photoconductive drum 62 by a predetermined space by space holding members 38 which are attached to both end parts of the developing roller 32 in the rotation axial direction, which are illustrated in FIG. 6.

Next, a configuration of the developing unit 20 will be described by using FIG. 3, FIG. 6, and FIGS. 8A to 8C. FIG. 6 is an exploded perspective view for explaining the configuration of the developing unit 20.

A developing frame composed of the developing container 23 (first frame) and the bottom member 22 (second frame) forms the toner chamber 29 in which the toner 2 is accommodated and the toner supply chamber 28, both of which are illustrated in FIG. 3. The developing container 23 and the bottom member 22 are integrally combined by welding or the like.

The conveyance member 43 is composed of a conveyance sheet 44 and a rotating member 45. The rotating member 45 is a rotating body which is supported rotatably by the developing container 23 and is able to stir the toner 2 in the toner chamber 29. Therefore, the rotating member 45 is to be arranged at a position which allows contact with the toner 2.

Figure 8A:
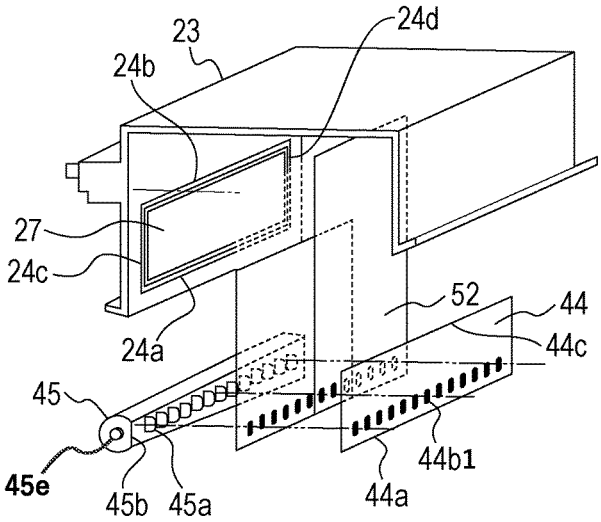
FIGS. 8A to 8C are plan views for explaining the toner sealing configuration and the positional relation between the toner sealing member and the sealing portion according to the first example.
Figure 8B:
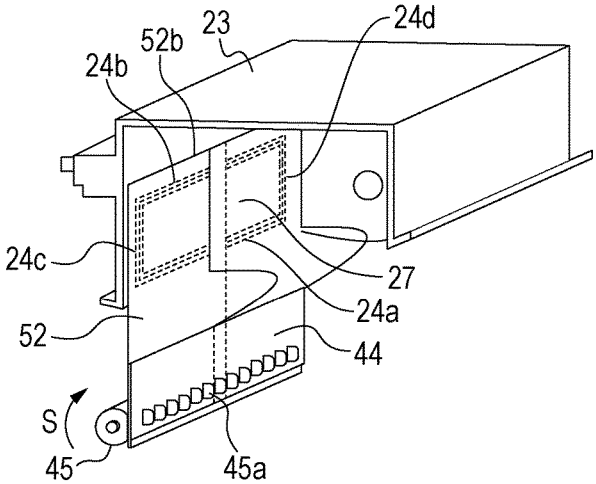
Figure 8C:
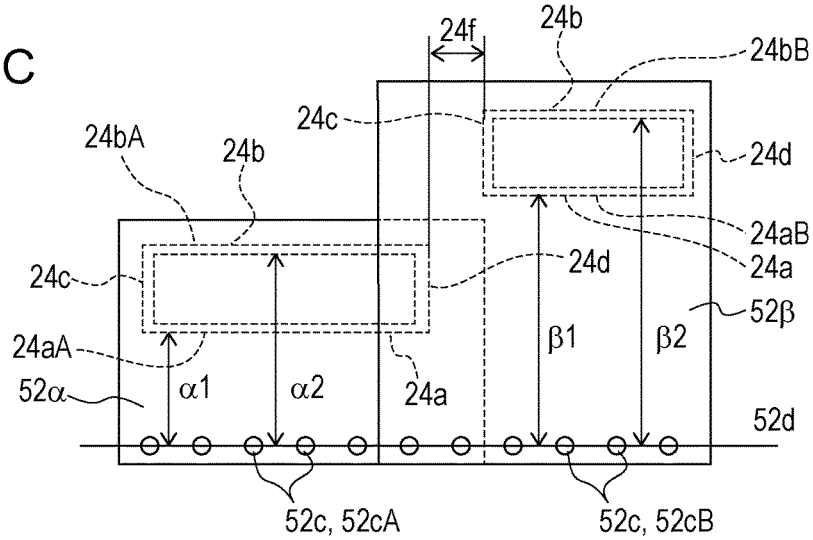

Moreover, the rotating member 45 fixes toner sealing members 52α and 52β each of which serves as a partition member that seals the toner supply opening 27 serving as an opening unsealably, which communicates with the toner chamber 29. When the rotating member 45 rotates and rolls up the toner sealing members 52α and 52β, a sealing portion 24 of the frame illustrated in FIGS. 8A to 8C is separated from the toner sealing members 52α and 52β and then the toner supply opening 27 is opened. Thus, the rotating member 45 of the present example serves or functions as an opening member. The sealing portion 24 is arranged so as to extend in a longitudinal direction of a cartridge B, and seals the toner supply opening 27 unsealably. In the present example, the partition member also serves as the sealing member that seals the opening, but is not limited thereto and includes a member which is in a state of not sealing the periphery of the opening completely. For example, a configuration in which the partition member is nipped by a nipping portion which is on a frame side and the partition member covers the opening so that leakage of the toner 2 is reduced may be provided.

Moreover, the sealing portion 24 has at least a first sealing portion 24*a* and a second sealing portion 24*b*, and does not seal a sealing portion gap 24*f*.

A configuration of a toner sealing member 52 serving as the partition member is as follows. As illustrated in FIG. 8C, there are two sheets of the first toner sealing member 52α and the second toner sealing member 52β serving as a first partition member and a second partition member, respectively, which overlap with each other in a longitudinal direction of the opening (right-and-left direction in FIG. 8C). For the first toner sealing member 52α, a distance between a center line 52*d* of attachment holes (first fixed portions 52*c*A) and the first sealing portion 24*a* (first A sealing portion 24*a*A) is set as α1. Moreover, a distance between the center line 52*d* of the attachment holes (first fixed portions 52*c*A) of the first toner sealing member 52α and the second sealing portion 24*b* (second A sealing portion 24*b*A) is set as α2. Further, for the second toner sealing member 52β, a distance between the center line 52*d* of attachment holes (second fixed portions 52*c*B) and the first sealing portion 24*a* (first B sealing portion 24*a*B) is set as β1. Moreover, a distance between the center line 52*d* of the attachment holes (second fixed portions 52*c*B) of the second toner sealing member 52β and the second sealing portion 24*b* (second B sealing portion 24*b*B) is set as β2. In this case, $\alpha 1 \neq \alpha 2 \neq \beta 1 \neq \beta 2$ is satisfied. Moreover, $\alpha 1 < \beta 1$ and $\alpha 2 < \beta 2$ are provided. For the rotating member 45 of the present embodiment, one that is solid and able to secure sufficient rigidity is adopted.

In the present example, as a reference for the fixed portions, distances from the center line 52*d* of the attachment holes to the first sealing portions 24*a* (the first A sealing portion 24*a*A and the first B sealing portion 24*a*B) of the first partition member and the second partition member have a distance relation of $\alpha 1 < \beta 1$. Thereby, timings of separation are made different, and thus maximum torque is reduced, and further, since a higher torque peak is divided into two lower torque peaks, it is possible to reduce a load on a motor which is a driving source. Accordingly, the motor does not need to be replaced with an expensive motor or a larger motor, each of which has high power. A similar phenomenon also occurs when the second sealing portion 24*b* is separated or peeled off. The second sealing portion 24*b* also includes the second A sealing portion 24*b*A of the first toner sealing member 52α and the second B sealing portion 24*b*B of the second toner sealing member 52β, and a distance relation with the fixed portions satisfies α2<β2. Therefore, when the second sealing portion 24*b* is separated or peeled off from the frame, it is possible to perform separation from the frame with reduced torque compared with a linear sealing portion welded to a frame, thus making it possible to easily open the opening.

A nondrive side of the conveyance member 43 is supported rotatably by the developing container 23, and a drive side thereof is fixed to a conveyance gear 50 which is attached rotatably to the developing container 23. Thereby, the conveyance member 43 rotates in the toner chamber 29 in accordance with rotation of the conveyance gear 50.

As illustrated in FIG. 6, in addition to the toner sealing members by which the opening is sealed, a plurality of toner sealing members 55 to 58 are arranged to prevent the toner from leaking.

Each of the toner sealing members 55 to 57 in FIG. 6, whose reference signs are 55 to 57, is fixed to a predetermined position of the developing container 23 with a two-sided adhesive tape or the like.

The toner sealing member 58 in FIG. 6, whose reference sign is 58, is fixed to a predetermined position of the bottom member 22 with a two-sided adhesive tape or the like after the developing container 23 and the bottom member 22 are combined.

The toner sealing members 55 in FIG. 6, whose reference sign is 55, prevent the toner 2 from leaking from both end parts of an elastic member 42*b* of the developing blade 42 in a longitudinal direction thereof.

The toner sealing members 56 in FIG. 6, whose reference sign is 56, prevent the toner 2 from leaking from both end parts of the developing roller 32 in a longitudinal direction thereof.

The toner sealing member 57 in FIG. 6, whose reference sign is 57, is provided over the full length of the developing blade 42 in the longitudinal direction thereof, and prevents the toner 2 from leaking from a rear side of a support member 42*a* of the developing blade 42.

The toner sealing member 58 in FIG. 6, whose reference sign is 58, is provided over the full length of the developing roller 32 in the longitudinal direction thereof so as to be in contact with the developing roller 32, and prevents the toner 2 from leaking from a lower side of the developing roller 32 in FIG. 6.

The developing blade 42 is configured by including the support member 42*a* formed of a sheet metal and the elastic member 42*b* formed of an elastic material such as urethane rubber. By inserting screws 93 into through-holes provided in both end parts of the support member 42*a* in a longitudinal direction thereof, the developing blade 42 is fixed to the developing container 23 serving as the first frame at a predetermined position with a cleaning member 47.

A developing roller unit 31 is configured by including the developing roller 32, the magnet roller 34, a flange 35, the space holding members 38, bearing members 37, a developing roller gear 39, and the like.

The magnet roller 34 is inserted from an opening end part on a nondrive side of the developing roller 32 (right side in FIG. 6), and the flange 35 is press-fitted to the opening end part.

In the present example, respective rotation axes of the photoconductive drum 62, the rotating member 45, and the developing roller 32 are arranged in parallel to each other.

A conductive electrode wire which is not illustrated is embedded in the flange 35, and the electrode wire is electrically connected to the developing roller 32 and an electrode plate 127.

The electrode plate 127 which is conductive is fixed to the side member 26L provided in the nondrive side which is illustrated in the right side of FIG. 6.

The electrode plate 127 is electrically in contact with a power feeding portion of the apparatus main body A, which is not illustrated, and supplies power to the developing roller 32 with the electrode plate 127 and not-illustrated electrode wire as a power feeding path.

The space holding members 38 are attached to the both end parts of the developing roller 32 in the rotation axial direction. The bearing members 37 are respectively arranged further outside. In a drive side which is illustrated in a left side of FIG. 6, the developing roller gear 39 is embedded on an outside of the bearing member 37.

The developing roller 32 is supported rotatably by the bearing members 37 which are arranged on the both end parts of the developing roller 32 in the rotation axial direction.

Figure 5:
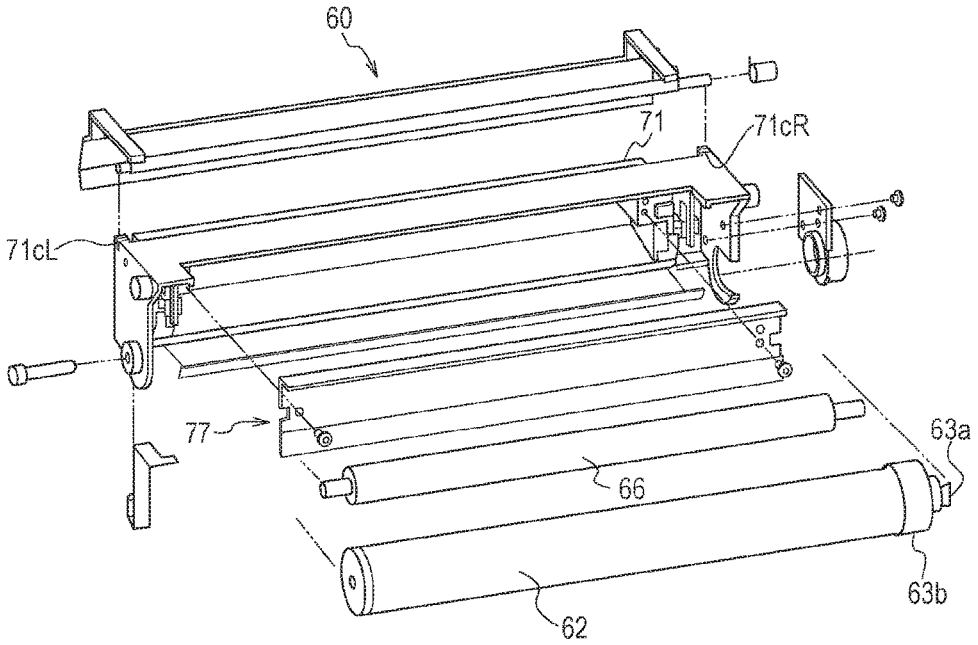
FIG. 5 is a perspective view for explaining a configuration of a cleaning unit according to the first example.

Gears 48 and 49 which serve as drive transmission members are attached rotatably to the developing frame. Thereby, a driving force is received by a driving force receiving portion 63*a*, which is illustrated in FIG. 5, from a drive shaft of the apparatus main body A. When a flange gear portion 63*b*, the developing roller gear 39, the gears 48 and 49, and the conveyance gear 50, which are illustrated in FIG. 5 and FIG. 6, are sequentially engaged and rotate, the driving force received by the driving force receiving portion 63*a* is transmitted to the developing roller 32 and the conveyance member 43.

As illustrated in FIG. 6, the side member 26L and 26R are respectively fixed to both end parts of the developing frame in a longitudinal direction thereof by using screws 92. At this time, the bearing members 37 of the developing roller unit 31 are respectively held by the side members 26L and 26R.

<Configurations of Toner Sealing Member and Toner Conveyance Member which Serve as Partition Members>

Next, a configuration of the toner sealing member 52 having the sealing portion 24 which seals the toner supply opening 27 unsealably and attachment holes 52*c* which are attachment portions by which the toner sealing member 52 is attached to the rotating member 45 (also serving as the opening member) will be described by using FIGS. 1A to 1C, FIGS. 7A to 7D, and FIGS. 8A to 8C.

In the present embodiment, the attachment portions (fixed portions) of the toner sealing member 52, by which the toner sealing member 52 is attached to the rotating member 45, mean parts (fixed portions) of the toner sealing member 52, which correspond to the center line 52*d* of holes passing through the center of each of the plurality of attachment holes 52*c*. A length between the sealing portion 24 of the toner sealing member 52 and the attachment portions in a direction intersecting with (orthogonal to) the longitudinal direction of the cartridge B means a length between edge parts of the sealing portions 24*a* and 24*b* on a side of the attachment holes 52*c* and the center line 52*d* of the holes in FIG. 8C for convenience.

In addition, the sealing portion 24 has at least the first sealing portion 24*a* (the first A sealing portion 24*a*A and the first B sealing portion 24*a*B) and the second sealing portion 24*b* (the second A sealing portion 24*b*A and the second B sealing portion 24*b*B).

The configuration of the toner sealing member 52 is as follows. That is, as illustrated in FIG. 8C, the toner sealing member 52 includes two sheets of the toner sealing members 52α and 52β which overlap with each other in the longitudinal direction of the opening (right-and-left direction in FIG. 8C). In a case where, for the first toner sealing member 52α, the distance between the center line 52*d* of the attachment holes and the sealing portion 24*a* (first A sealing portion 24*a*A) is set as α1, and the distance between the center line 52*d* of the attachment holes and the sealing portion 24*b* (second A sealing portion 24*b*A) is set as α2, and, for the second toner sealing member 52β, the distance between the center line 52*d* of the attachment holes and the sealing portion 24*a* (first B sealing portion 24*a*B) is set as 1, and the distance between the center line 52*d* of the attachment holes and the sealing portion 24*b* (second B sealing portion 24*b*B) is set as β2, $\alpha 1 \neq \alpha 2 \neq \beta 1 \neq \beta 2$ is satisfied. Moreover, $\alpha 1 < \beta 1$ and $\alpha 2 < \beta 2$ are provided.

FIGS. 7A to 7D are perspective explanatory views for explaining an opening operation of the toner sealing member 52 in the present embodiment. FIG. 8A is an exploded perspective view for explaining a positional relation of the toner supply opening 27 communicating with the toner chamber 29, the toner sealing member 52, the sealing portion 24, the rotating member 45, and the conveyance sheet 44 in the present embodiment. FIG. 8B is a perspective explanatory view illustrating a situation where, in the present embodiment, the toner supply opening 27 communicating with the toner chamber 29 is sealed with the sealing portion 24 of the toner sealing member 52 and the toner sealing member 52 and the conveyance sheet 44 are mounted on the rotating member 45. FIG. 8C is a plan view illustrating the configuration of the toner sealing member 52 in the present embodiment. Note that, for convenience of description, the conveyance sheet 44 is omitted in FIGS. 7A to 7D.

As illustrated in FIGS. 1A to 1C, FIGS. 7A to 7D, and FIGS. 8A to 8C, the developing container 23 is provided with the toner supply opening 27 through which the toner chamber 29 and the toner supply chamber 28 communicate with each other.

In the present example, the toner sealing member 52 which seals the toner supply opening 27 unsealably is formed of a material which has compatibility with a material of the developing container 23 or a material which has an adhesive layer.

In the present example, for example, a material such as polyethylene terephthalate (PET), which has flexibility, is used for the conveyance sheet 44 which is fixed to the rotating member 45 serving as the opening member. Moreover, a material such as polycarbonate (PC) or polyphenylene sulfide (PPS), which has flexibility, is used.

As illustrated in FIG. 8A, the attachment holes 52*c* which are formed by through-holes of the toner sealing member 52 and through-holes 44*b*1 of the conveyance sheet 44 are sequentially fitted to projecting parts 45*a* of the rotating member 45 serving as the opening member. Thereafter, when the projecting parts 45*a* of the rotating member 45 are subjected to heat shrinking, the toner sealing member 52 and the conveyance sheet 44 are integrally fixed to a flat surface 45*b* of the rotating member 45, as illustrated in FIG. 8B.

In the present example, the conveyance member 43 including the conveyance sheet 44 is fixed also to the toner sealing member 52 serving as a sealing member. A shape of the partition member may be appropriately selected, in accordance with a configuration thereof, from a sheet shape, a strip shape, a trapezoidal shape, a parallelogram shape, and the like. Accordingly, the conveyance member 43 functions also as the opening member. However, there is no limitation thereto, and the conveyance member 43 and the opening member may be configured by different members. In addition, the opening member is not required to be a rotating member, and may have a configuration for moving in a horizontal direction to thereby cause the toner sealing member 52 serving as the partition member to move for opening the opening, for example.

Note that, a method of fixing the toner sealing member 52 and the conveyance sheet 44 to the rotating member 45 may be another one such as welding, snap-fit, fixation with a two-sided adhesive tape, or the like, and it is not necessary to limit the fixing method.

The toner sealing member 52 needs to have a length which is long enough to cover the toner supply opening 27 and be attached to the rotating member 45. Here, attachment phases of the conveyance sheet 44 (44*a*, 44*b*) and the toner sealing member 52 are set to be the same so that a front edge part 52*b* of the toner sealing member 52 does not overlap with a front edge part 44*c* of the conveyance sheet 44 after opening the toner sealing member 52. That is, as illustrated in FIGS. 7A to 7D, provided is a configuration in which the toner sealing member 52 is rolled up along an outer peripheral surface of the rotating member 45 in accordance with rotation of the rotating member 45 in a direction of an arrow S of FIGS. 7B to 7D, and thereby the front edge part 52*b* of the toner sealing member 52 does not overlap (cover) with the front edge part 44*c* of the conveyance sheet 44.

As illustrated in FIG. 8B, a side of the front edge part 52*b* of an opening side of the toner sealing member 52 is fixed unsealably to the developing container 23 along an opening edge of the toner supply opening 27 by heat welding or the like. This fixed part is set to be the sealing portion 24.

The toner sealing member 52 is connected when the projecting parts 45*a* which are provided on the flat surface 45*b* of the rotating member 45 so as to project are inserted into and engaged with the attachment holes 52*c* composed of the plurality of through-holes which serve as the attachment portions and are arranged in an edge part 52*a* on one end side (fixed side) continuously at a predetermined pitch. Further, the sealing portion 24 which seals the toner supply opening 27 serving as the opening is provided in the front edge part 52*b* which is on the other end side.

A material of the toner sealing member 52 is not particularly limited, but the toner sealing member 52 can be made of a material such as PET, PC, or PPS, which has flexibility, and further, the material can have an adhesive layer which is melted by heating and adheres to the container. Moreover, phase separation sealing which includes a plurality of materials may be adopted.

In the present example, a PET film which has a thickness of 50 μm and includes an adhesive layer capable of being melted by heating and adhering to the container is used.

In this case, a forming method of the sealing portion 24 of the toner sealing member 52 on the developing container 23 may be a method other than heat welding, and, for example, also by adhesion, laser welding, or the like, the sealing portion 24 may be fixed so as to be able to be separated. Moreover, a configuration in which a projecting part is formed from the developing container 23, which serves as the frame, so as to nip the toner sealing member 52 may be provided.

As illustrated in FIGS. 8A to 8C, the sealing portion 24 includes the sealing portions 24*a* and 24*b* which are arranged along a longitudinal direction of the toner supply opening 27 so as to be in parallel to a direction of a rotation axis 45*e* of the rotating member 45.

A geometric tolerance value of parallelism of the sealing portion 24 (first sealing portion 24*a*, second sealing portion 24*b*) and the rotation axis 45*e* of the rotating member 45 is approximately 5 mm. In addition, each of the sealing portions 24*a* and 24*b* includes a linear part in a longitudinal direction thereof (right-and-left direction in FIG. 7C).

Furthermore, the sealing portion 24 includes sealing portions (third sealing portion 24*c*, fourth sealing portion 24*d*) each of which is arranged along a transverse direction of the toner supply opening 27 in a direction orthogonal to the direction of the rotation axis 45*e* of the rotating member 45.

In the present example, the sealing portions 24*a*, 24*b*, 24*c*, and 24*d* are formed in a quadrilateral shape in an outer peripheral edge part of the toner supply opening 27 as illustrated in FIGS. 7A to 7D. However, there is no limitation thereto, and a trapezoidal shape or a rhombic shape may be adopted. Moreover, the sealing portion (third sealing portion 24*c*, fourth sealing portion 24*d*) is not necessarily sealed.

Note that, the first sealing portion 24*a* and the second sealing portion 24*b* are arranged in parallel, and furthermore, are arranged in parallel also to the rotation axis 45*e* of the rotating member 45 serving as the opening member.

Figure 7A:
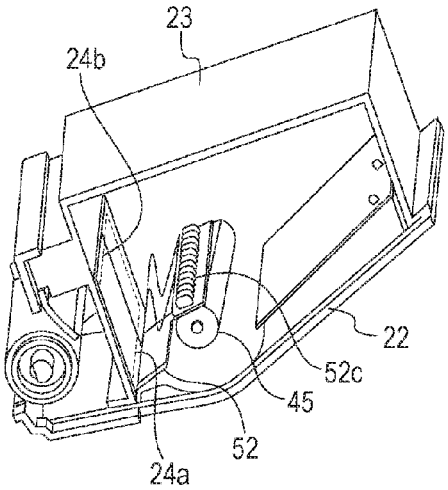
FIGS. 7A to 7D are sectional views illustrating an opening operation of the toner sealing member according to the first example.
Figure 7B:
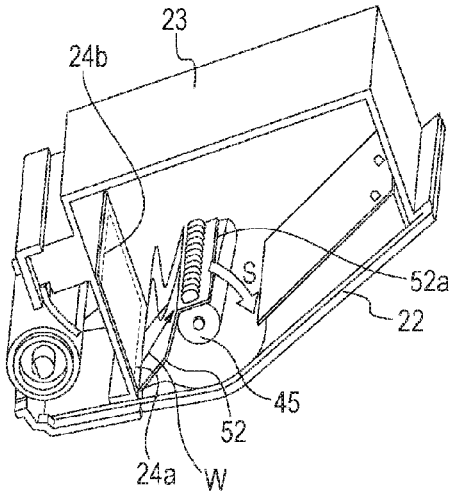

The rotating member 45 rotates in the direction of the arrow S of FIG. 7B. One end side (back side in FIG. 7B) of the direction of the rotation axis 45*e* (rotation axial direction) of the rotating member 45 is set as a drive side to which a rotational driving force is transmitted, and the other end side (front side in FIG. 7B) is set as a nondrive side.

Figure 7C:
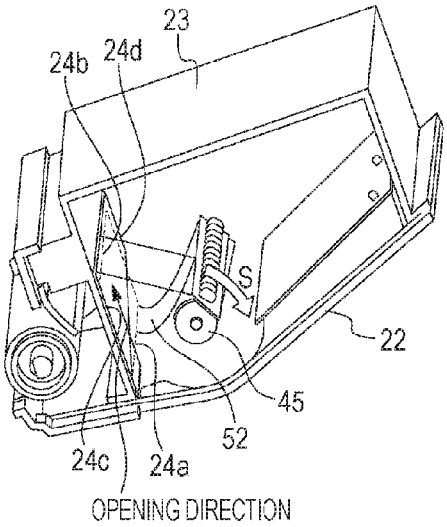

An opening direction in which the opening is opened means a direction which is parallel to a surface including the opening and an upward direction from a lower part of the opening in FIGS. 7B and 7C. Therefore, the first sealing portion 24*a* of the toner sealing member 52 is positioned on an upstream side of the opening direction with respect to the opening, and the second sealing portion 24*b* is positioned on a downstream side of the opening direction with respect to the opening.

On the other hand, the second sealing portion 24*b* which is positioned on the downstream side (FIG. 7A) of the opening direction of the toner supply opening 27 is positioned on the side of the front edge part 52*b* of the opening side of the toner sealing member 52 when viewed from the toner supply opening 27.

In addition, the third sealing portion 24*c* is positioned on the nondrive side illustrated in a left side in FIG. 7C, and the fourth sealing portion 24*d* is positioned on the drive side illustrated in a right side in FIG. 7C.

A positional relation between the toner sealing member 52 and the sealing portion 24 will be described further in detail by using FIG. 7C.

The rotating member 45 serving as the opening member rotates in the direction of the arrow S of FIG. 7B, and then the toner sealing member 52 is rolled up on the outer peripheral surface of the rotating member 45. When the toner sealing member 52 is rolled up by the rotating member 45, the sealing portion 24 is separated and a part of the opening is opened as FIG. 7C. In FIG. 7C, there are two toner sealing members, and the first toner sealing member 52α is separated from the frame first to open a part of the opening.

In the present embodiment, the sealing portion 24 is opened by rolling up the toner sealing member 52 by the rotating member 45. At this time, magnitude of tension applied between the sealing portion 24 (sealing portions 24*a* to 24*d*) of the toner sealing member 52 and the attachment holes 52*c* composed of the through-holes serving as the attachment portions by which the toner sealing member 52 is attached to the rotating member 45 is important.

In the present embodiment, two sheets of the first and second toner sealing members 52α and 52β which overlap with each other in the longitudinal direction of the opening (right-and-left direction in FIG. 8C) are included as illustrated in FIG. 8C. The distances which are described above and defined include the distance α1, the distance α2, the distance β1, and the distance β2, and a relation of $\alpha 1<\alpha 2<\beta 1<\beta 2$ is satisfied in the present example.

The above-described magnitude of the tension applied between the toner sealing member 52 and the attachment holes 52*c* depends on a sealing area. In a case where the toner sealing member 52 is rolled up in accordance with the above-described process, the maximum tension is substantially proportional to a length of sealing (length of the opening in the longitudinal direction).

In order to reduce the maximum tension (or maximum torque), in the present embodiment, the distances α1, α2, β1, and β2 between the center line 52*d* of the attachment holes 52*c* and the respective sealing portions are differentiated by dividing the length of the opening in the longitudinal direction so as to correspond to two sheets. The first and second toner sealing members 52α and 52β are arranged so as to cover the opening, and are not required to completely seal the periphery of the opening by welding. That is, overlapping parts of the first and second toner sealing member 52α and 52β do not need to be sealed by welding or the like since they overlap with each other in the overlapping parts. The overlapping parts are arranged at a position overlapping with the opening in a direction perpendicular to the surface including the opening. A non-sealing portion 24*f* illustrated in FIG. 8C is able to be provided, so that it is possible to reduce the sealing area as a whole compared with a conventional one in which sealing is performed continuously in a longitudinal direction of an opening. When a length of the non-sealing portion 24*f* in the longitudinal direction of the opening is lengthened, an area to be welded becomes small and torque is also able to be reduced.

<Opening Operation of Toner Sealing Member Serving as Partition Member>

Figure 9:
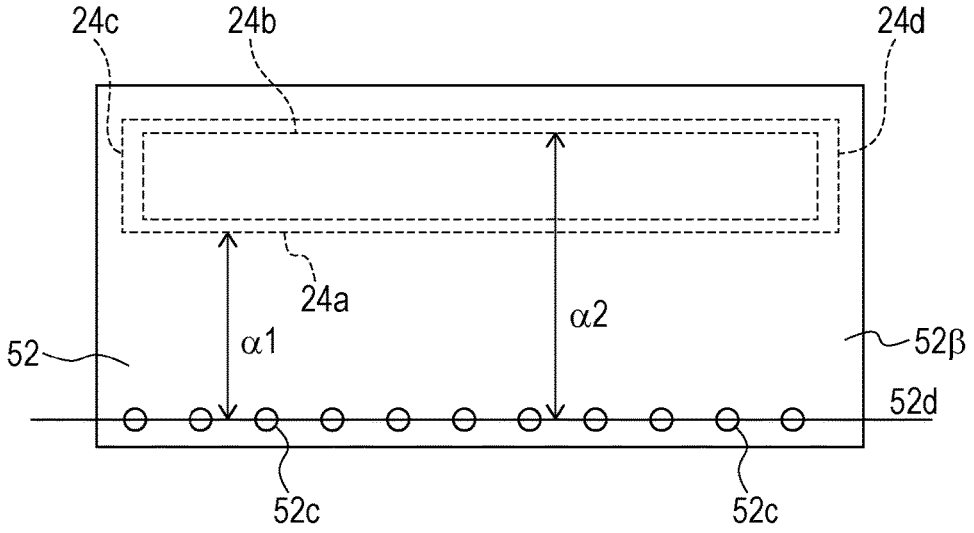
Prior Art FIG. 9
FIG. 9 is a plan view for explaining a toner sealing configuration serving as a comparative example.

Next, an opening operation of the toner sealing member 52, which is performed at a time of starting usage of the cartridge B, will be described by using FIGS. 7A to 7D to FIG. 9. FIG. 9 is an explanatory view for explaining a method of separating the toner sealing member 52 of a comparative example.

First, as illustrated in FIG. 7A, the whole of the toner sealing member 52 is slackened off so that tension is not applied to the toner sealing member 52 between the sealing portion 24 of the first and second toner sealing members 52α and 52β and the center line 52*d* of the holes, which passes through each center of the attachment holes 52*c* serving as the attachment portions to the rotating member 45. Thereby, even when an external force is applied to the rotating member 45 at a time of assembling the cartridge B or a time of physical distribution, tension is difficult to be applied to the toner sealing member 52 since the toner sealing member 52 is slackened off. Accordingly, it is possible to maintain a sealing ability of the toner sealing member 52 by the sealing portion 24. Note that, in order to facilitate understanding the opening operation of the toner sealing member 52, the toner 2, the conveyance sheet 44, and the like are omitted in FIGS. 7A to 7D.

As illustrated in FIG. 7A, immediately before starting the opening operation of the toner sealing member 52, the whole of the toner sealing member 52 is slackened off similarly to a state immediately after the assemblage, and tension is not applied to the toner sealing member 52.

As illustrated in FIG. 7B, when the cartridge B is attached to the apparatus main body A and driven by the apparatus main body A, the rotating member 45 rotates in the direction of the arrow S of FIG. 7B. Then, the edge part 52*a* of the fixed side of the toner sealing member 52 is rolled up by the rotating member 45. Thereby, the toner sealing member 52 between the sealing portion 24*a* and the center line 52*d* of the holes is pulled in a direction of an arrow W of FIG. 7B.

At this time, as the distance between the center line 52*d* of the attachment holes 52*c* and the sealing portion 24*a* or 24*b* in FIG. 8C, α1, α2, β1, and β2 are provided in the present embodiment. Since the distance α1 is the shortest, tension is applied to the first A sealing portion 24*a*A of the first toner sealing member 52α first. When this tension is increased and exceeds limit of welding strength of the first A sealing portion 24*a*A, the first A sealing portion 24*a*A is separated.

In accordance with the rotation of the rotating member 45 as illustrated in FIG. 7C, the sealing portion at the distance α2 (in this case, the second A sealing portion 24*b*A of the first toner sealing member 52α), at which the distance between the center line 52*d* of the attachment holes 52*c* and the sealing portion is the second shortest, is separated.

Figure 7D:
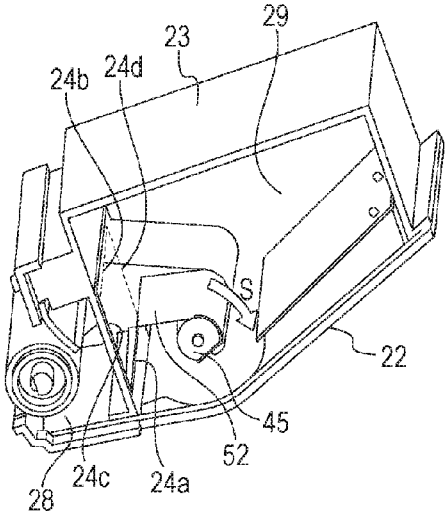

As illustrated in FIG. 7D, the rotating member 45 rotates even after the separation of the first toner sealing member 52α is finished. When the rotating member 45 rotates, tension is applied between the second toner sealing member 52β and the sealing portion. When the rotating member 45 further rotates, the first B sealing portion 24*a*B and the second B sealing portion 24*b*B of the second toner sealing member 52β are sequentially separated from the frame.

Accordingly, in comparison with the comparative example illustrated in FIG. 9, a region (in a longitudinal direction) of separating each of the sealing portions 24*a* and 24*b* of the toner sealing member 52 at the same timing becomes narrow, so that the configuration in FIGS. 8A to 8C makes it possible to reduce a rolling-up force (torque) more.

Furthermore, in the overlapping parts of the toner sealing members 52α and 52β, since they overlap with each other, respective sealing abilities are exerted, so that it is not necessary to perform sealing. Therefore, it is possible to provide the non-sealing portion 24*f* illustrated in FIG. 8C, thus making it possible to reduce the sealing area as a whole compared with the one in which sealing is performed continuously in the longitudinal direction of the opening as illustrated in FIG. 9.

A region of the non-sealing portion 24*f* is not particularly limited, but is preferably not less than 5% and less than 50% of a region, which is continuously sealed in the longitudinal direction, in order to achieve both of an effect of reducing a rolling-up force and maintenance of a toner sealing ability.

In the case of being less than 5%, while an effect of dispersing the rolling-up force is achieved by a plurality of sheets of sealing members, since the region of the non-sealing portion 24*f* is too small, an effect of reducing the sealing area itself is small.

In the case of being 50% or more, since the sealing members overlap too much, an adhesion area of the sealing members and the developing opening becomes small, so that the toner sealing ability is reduced in some cases.

On the other hand, the overlapping parts may be fixed by welding. In this case, for the toner sealing member 52 of FIG. 8C, the second toner sealing member 52β is welded to the frame first, and the first toner sealing member 52α is welded thereon. Thereby, the part of the first toner sealing member 52α, which overlaps with the second toner sealing member 52β, is to be welded to the second toner sealing member 52β. In such a configuration, arrangement is performed in an order of the opening, the second toner sealing member 52β, and the first toner sealing member 52α in the direction perpendicular to the surface including the opening.

Note that, in the present embodiment, an example of the configuration in which the attachment holes 52*c* composed of the through-holes are fitted to the projecting parts 45*a* provided on the flat surface 45*b* of the rotating member 45 so as to project has been described as a method of attaching the attachment portions of the toner sealing member 52, by which the toner sealing member 52 is attached to the rotating member 45.

Additionally, without using the attachment holes 52*c* composed of the through-holes, fixation may be performed by attaching one end side of the toner sealing member 52 to the rotating member 45 with a two-sided adhesive tape, an adhesive, or the like. In this case, the two-sided adhesive tape, the adhesive, or the like is used for each distance from a fixed surface (fixed portion) of the toner sealing member 52, which corresponds to a fixing surface of the rotating member 45, to the sealing portions 24*a* and 24*b* in a direction of rolling up the toner sealing member 52. It is possible to achieve reduction in torque by changing the distance.

Figure 10A:
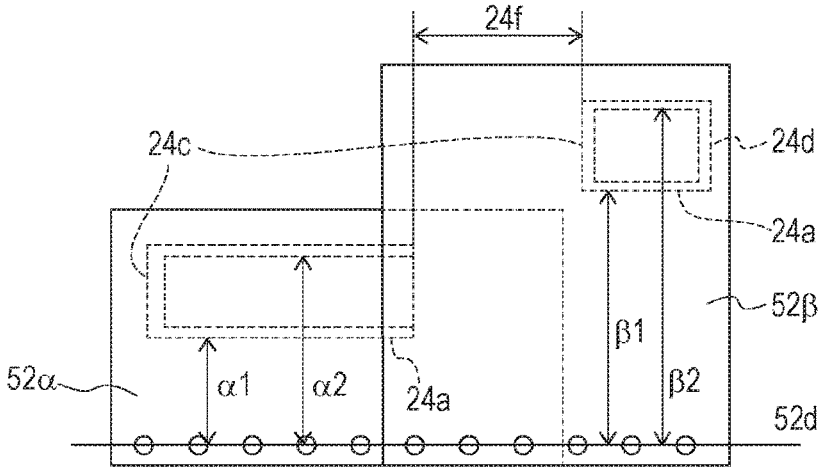
FIGS. 10A to 10C are examples of the toner sealing configuration according to the first example.
Figure 10B:
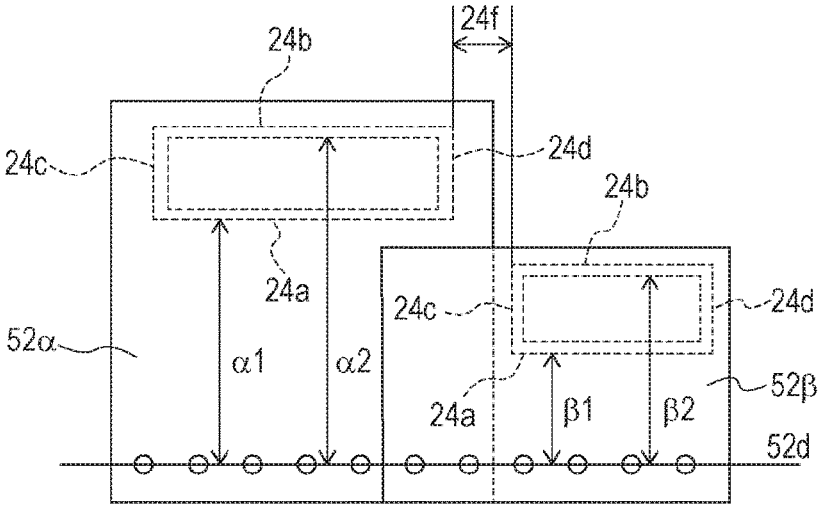
Figure 10C:
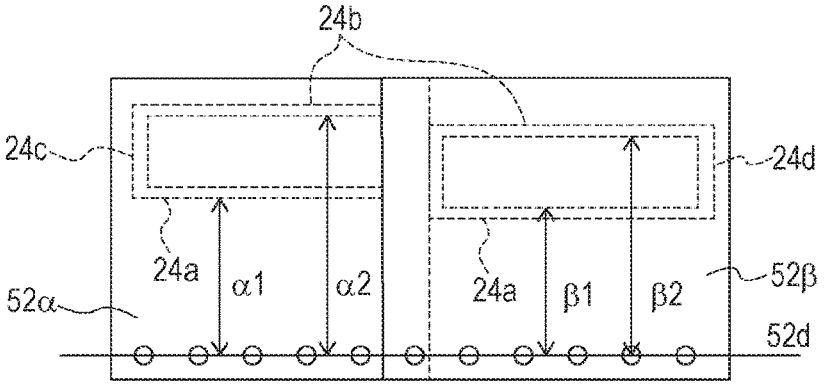

Further, examples of a configuration by which an effect similar to that of the first embodiment is able to be achieved are illustrated in FIGS. 10A to 10C.

In FIG. 10A, a way of overlapping the first and second toner sealing members 52α and 52β in the longitudinal direction of the opening is modified. The first toner sealing member 52α and the second toner sealing member 52β are arranged in a state of covering at least a part of the opening. In the configuration of FIG. 10A, the overlapping parts of the first toner sealing member 52α and the second toner sealing member 52β include the sealing portion 24 to be welded to the opening. The overlapping parts may not include the sealing portion, which will be described below.

In FIG. 10B, an overlapping amount of the first and second toner sealing members 52α and 52β is modified. In this modified example, a difference of distances between α1 and β1 is made great, so that there is almost no influence at a time of separating each sealing portion.

In FIG. 10C, though the first and second toner sealing members 52α and 52β have the same length, the distances α1, α2, β1, and β2 between the center line 52*d* of the attachment holes 52*c* and the respective sealing portions 24*a* and 24*b* are differentiated by deviating positions of the respective sealing portions 24*a* and 24*b*.

Thereby, it is possible to reduce a load of automatically rolling up the toner sealing member 52. Accordingly, it becomes unnecessary to replace a motor which drives the rotating member 45 with a large motor whose power is great. Moreover, it becomes unnecessary to replace the motor with an expensive one which has high power, as well. Thus, it becomes possible to miniaturize the apparatus main body A of the image forming apparatus and reduce the costs.

Example 2

A second embodiment of the disclosure will be specifically described.

Since the apparatus main body A of the image forming apparatus and the image forming process which are the same as those of the example 1 are used in the example 2, description will be given for the toner sealing member 52.

As to a cartridge, in a case where an external force is applied to the cartridge due to a large oscillation during transportation or the like, pressure inside a developing portion is increased and particle pressure of the toner 2 is also increased, so that the sealing portion is separated and the toner 2 leaks out of the developing portion in some cases.

Figure 13:
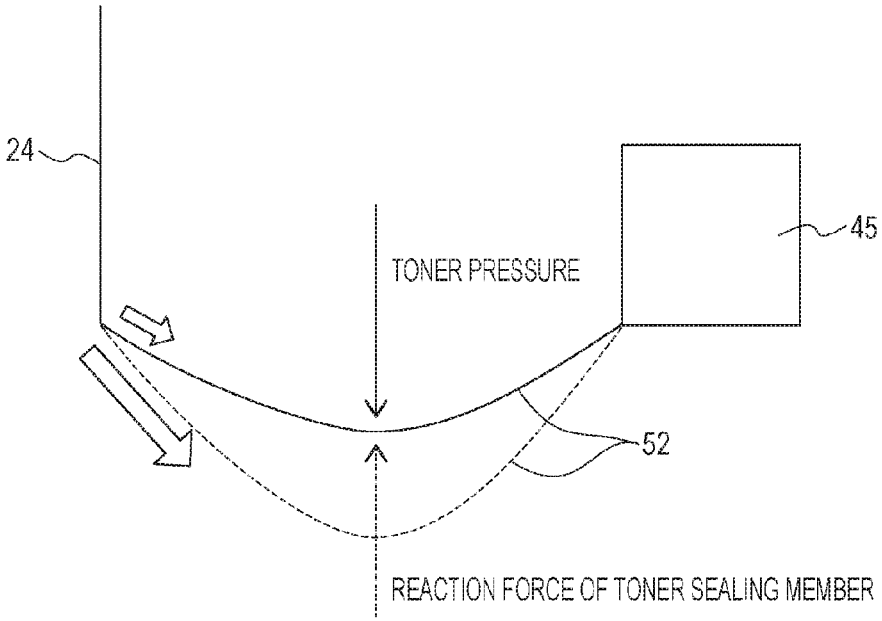
FIG. 13 is a schematic diagram of toner pressure and a reaction force which are applied during physical distribution of a cartridge.

As illustrated in FIG. 13, toner pressure is applied to the toner sealing member 52 in a direction of an arrow, and, at the same time, a reaction force of the toner sealing member 52 acts in a direction of a dotted arrow. At this time, when the reaction force is small, the toner pressure is applied in a direction of a white arrow, and a force by which the sealing portion 24 is separated becomes great.

Figure 12:
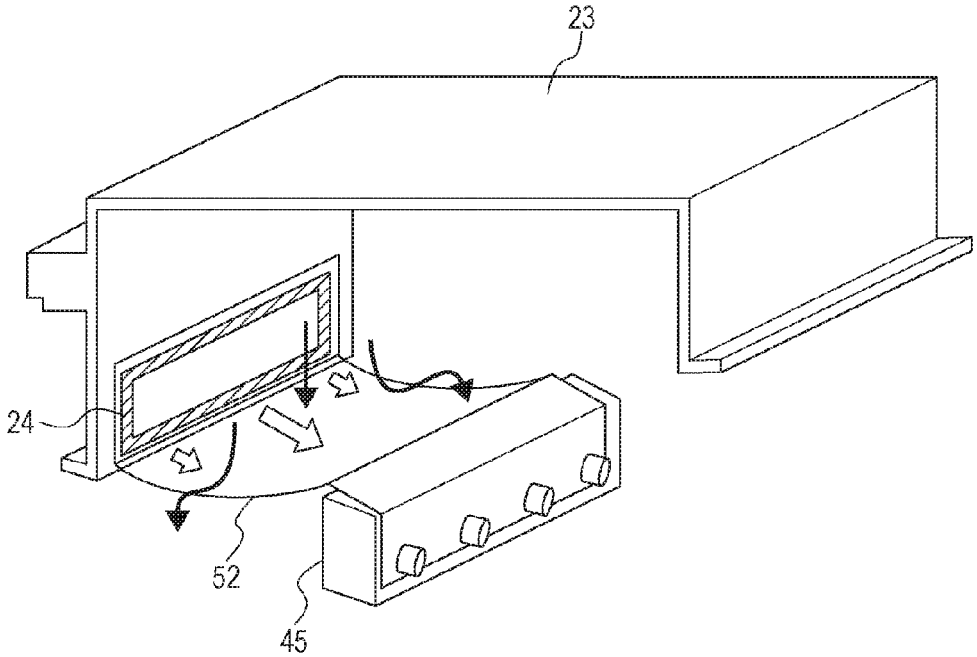
FIG. 12 is a schematic diagram of a force which is applied during physical distribution of a cartridge.

FIG. 12 illustrates movement of the toner 2 in a case where one toner sealing member 52 is provided and an external force is applied to the cartridge. When the external force is applied to the toner 2 in a direction of an arrow, a force of separating the toner sealing member 52 is applied in a direction of a white arrow.

Since the toner 2 in an end part in a longitudinal direction of the developing opening (rotation axial direction of the rotating member 45) is able to flow into a space (clearance part) outside the developing opening, in which the toner sealing member 52 is not provided, the force of separating or peeling the toner sealing member 52 becomes small, so that risk that the toner sealing member 52 is accidentally peeled off is low.

On the other hand, regarding the toner 2 in a center part of the developing opening in the longitudinal direction thereof, the whole of toner pressure is applied to the toner sealing member 52, so that great pressure is applied. Accordingly, a force of separating a center part of the toner sealing member 52 is great, and therefore the sealing member in the center part of the developing opening in the longitudinal direction thereof is separated and the toner 2 most easily leaks out therefrom in some cases.

Thus, as a method of coping with the force of separating the center part of the toner sealing member 52, a method of thickening a thickness of the toner sealing member 52 and enhancing a reaction force in the center part is mentioned as one improving method.

Figure 11:
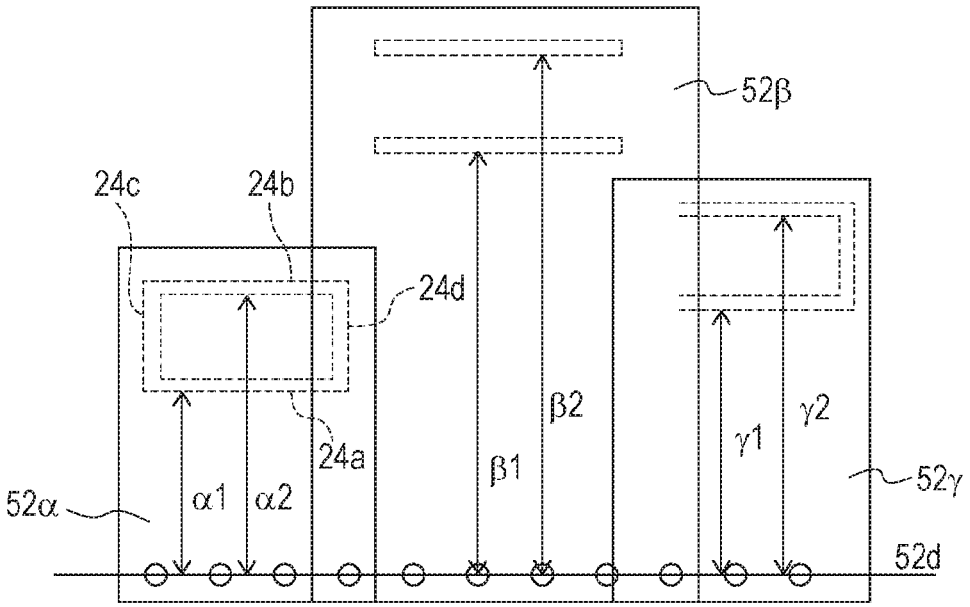
FIG. 11 is a plan view for explaining a toner sealing configuration and a positional relation between a toner sealing member and a sealing portion according to a second example.

In the example 2, as illustrated in FIG. 11, the number of sheets of toner sealing members 52 in the example 1 is changed to three, and a thickness of one toner sealing member among them, which serves as the partition member in the center part of the developing opening, is changed.

For each of the first and a third toner sealing members (52α, 52γ), a PET film which has a thickness of 50 μm and includes an adhesive layer capable of being melted by heating and adhering to the container is used. On the other hand, for the second toner sealing member 52β, a PET film which has a thickness of 100 μm and includes an adhesive layer capable of being melted by heating and adhering to the container is used.

As illustrated in FIG. 11, it is set that distances α1, α2, β1, β2, γ1, and γ2 between the center line 52*d* of the attachment holes 52*c* and the respective sealing portions satisfy $\alpha 1<\gamma 1<\alpha 2<\gamma 2<\beta 1<\beta 2$.

Accordingly, an adhesion area of each of the three sheets is smaller than those of the first example, and sealing is performed stepwise, so that it is possible to further reduce torque.

Against the aforementioned issue, the toner sealing member 52 is configured to include one sheet in the comparative examples illustrated in FIG. 9 and FIG. 12. Therefore, it is necessary to provide a configuration in which a material of an entirety of the toner sealing member 52 is able to resist the toner pressure in the center part, and, for example, a PET film of 100 μm is required to be used.

In the present example, since the plurality of toner sealing members 52 are provided, it is necessary to use a PET sheet of 100 μm only in the center part, and it is possible to use a sheet whose thickness is thin for other parts at which the toner 2 is difficult to leak out. As a result thereof, reduction in costs of materials is achieved while preventing the toner 2 from leaking out, so that it is possible to suppress an unnecessary increase in costs.

Example 3

A third embodiment of the disclosure will be specifically described.

The example 3 is a modified example of the example 2.

Regarding the toner sealing members 52α, 52β, and 52γ illustrated in FIG. 11, a PET film which has a thickness of 50 μm and includes an adhesive layer capable of being melted by heating and adhering to the container is used for the first and third toner sealing members 52α and 52γ in the example 3. On the other hand, a PPS film which has a thickness of 50 μm and includes an adhesive layer capable of being melted by heating and adhering to the container is used for the second toner sealing member 52β.

As a method of coping with a force of separating the center part of the toner sealing member 52, which is an issue of the example 2, a method of changing materials of the toner sealing member 52β to increase a reaction force against toner pressure in the center part is also one improving method.

Compared with PPS, tensile strength of PET is great, so that the reaction force against the toner pressure becomes great as well.

Accordingly, also in the present example, similarly to the example 2, it is possible to suppress the increase in costs while preventing the toner 2 from leaking out.

As described above, it is possible to further reduce torque in the examples 2 and 3 compared with the example 1. Furthermore, as a thickness, a shape, a material, and the like of the toner sealing member 52 are able to be selected more freely, it becomes possible to suppress an unnecessary increase in costs.

(Others)

Though description has been given by using the process cartridge so far, the disclosure is able to be applied also to a container (developer container) such as a toner supply cartridge, which accommodates developer. Moreover, a developing device having a developer bearing member is also able to independently have the configuration of the disclosure.

In addition, the image forming apparatus has been described as a monochrome image forming apparatus, but may be a color image forming apparatus. In this case, a configuration in which a plurality of developer containers and the like are detachably attachable is provided.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-078265 filed Apr. 8, 2016, which is hereby incorporated by reference herein in its entirety.

What is claimed is:

1. A developer container, comprising:

a frame that forms an opening and accommodates developer;

first and second partition members each of which covers at least a part of the opening; and an opening member that is arranged at a position that allows contact with the developer, fixes one edge of each of the first and second partition members, and opens the opening by causing the first and second partition members to move, wherein in a state where at least a part of the opening is covered with the first and second partition members, the first partition member includes an overlapping part at least a part of which overlaps with the second partition member, at least a part of the overlapping part overlaps with a part of the opening, and in a case of opening the opening, the first partition member moves away and separates from a part of the frame forming the opening earlier than the second partition member does wherein in a case where the overlapping part is set as a first overlapping part, the second partition member includes a second overlapping part that overlaps with the first partition member, and the first overlapping part includes a region that is not welded to the second overlapping part.

2. The developer container according to claim 1, wherein the first partition member includes a first sealing portion that covers at least a part of the opening and a first fixed portion one edge of which is fixed to the opening member, the second partition member includes a second sealing portion that covers at least a part of the opening and a second fixed portion one edge of which is fixed to the opening member, and a length from the first sealing portion of the first partition member to the first fixed portion is shorter than a length from the second sealing portion of the second partition member to the second fixed portion.

3. The developer container according to claim 1, wherein the first partition member and the second partition member are arranged in an order of the first partition member and the second partition member in an axial direction of the opening member to cover the opening.

4. The developer container according to claim 1, wherein the opening, the second partition member, and the first partition member are arranged in this order in a direction perpendicular to a surface that includes the opening.

5. The developer container according to claim 1, further comprising a third partition member that covers at least a part of the opening.

6. The developer container according to claim 1, wherein the opening member is driven by a drive transmission member with a driving force.

7. A developing device, comprising:

a developer bearing member that carries developer; and the developer container according to claim 1.

8. A process cartridge, comprising:

an image bearing member that carries a developer image; and the developer container according to claim 1.

9. An image forming apparatus, comprising the developer container according to claim 1, wherein an image is formed on a recording material.

* * * * *